US008683702B2

(12) United States Patent
Lo

(10) Patent No.: US 8,683,702 B2
(45) Date of Patent: Apr. 1, 2014

(54) FOLDING KNIFE CAPABLE OF PREVENTING AUTOMATIC FOLDING

(76) Inventor: Yen-Fen Lo, Kaohsiung (TW)

( * ) Notice: Subject to any disclaimer, the term of this patent is extended or adjusted under 35 U.S.C. 154(b) by 257 days.

(21) Appl. No.: 13/067,824

(22) Filed: Jun. 29, 2011

(65) Prior Publication Data

US 2012/0291291 A1 Nov. 22, 2012

(30) Foreign Application Priority Data

May 18, 2011 (TW) ..... 100208890 U

(51) Int. Cl.
*B26B 1/04* (2006.01)

(52) U.S. Cl.
USPC ..... 30/160; 30/161

(58) Field of Classification Search
USPC ..... 30/155, 158–161, 335–337
See application file for complete search history.

(56) References Cited

U.S. PATENT DOCUMENTS 5,502,895 A * 4/1996 Lemaire ..... 30/158
6,941,661 B2 * 9/2005 Frazer ..... 30/160
7,543,386 B2 * 6/2009 Sullivan ..... 30/160
2005/0183268 A1 * 8/2005 Chen ..... 30/161
2006/0162168 A1 * 7/2006 Kao ..... 30/161
2006/0260137 A1 * 11/2006 Flagg et al. ..... 30/160
2007/0151110 A1 * 7/2007 Chen ..... 30/155
2007/0169354 A1 * 7/2007 Ralph ..... 30/160
2007/0180702 A1 * 8/2007 Hawk et al. ..... 30/161
2007/0256304 A1 * 11/2007 Pardue et al. ..... 30/160
2008/0201953 A1 * 8/2008 Bremer et al. ..... 30/1
2008/0276462 A1 * 11/2008 Kao ..... 30/155
2008/0307656 A1 * 12/2008 Lin ..... 30/159
2009/0223061 A1 * 9/2009 Seber et al. ..... 30/160
2010/0083507 A1 * 4/2010 Glesser ..... 30/161
2011/0067246 A1 * 3/2011 Perez ..... 30/158

* cited by examiner

*Primary Examiner* — Boyer D Ashley
*Assistant Examiner* — Fernando Ayala
(74) *Attorney, Agent, or Firm* — Bacon & Thomas, PLLC

(57) ABSTRACT

A folding knife capable of preventing automatic folding, which includes a handle having first, second and third plates, and a blade pivotally connected between the first and second plates by a pivot. The second plate is provided with a resilient stopper having a first end fixed to the second plate and a second end extending toward the first plate in a slanting manner. The third plate has one side corresponding in position to the second plate and concavely provided with an engaging hole. When the blade is fully rotated out of the handle, the second end of the resilient stopper presses against one end of the blade and thereby keeps the blade fully rotated out of the handle. Thus, when a force applied to the blade is excessively large, the resilient stopper will not be shifted away from the position against the blade.

9 Claims, 7 Drawing Sheets

FOLDING KNIFE CAPABLE OF PREVENTING AUTOMATIC FOLDING

FIELD OF THE INVENTION

The present invention relates to a folding knife, more particularly to a folding knife capable of preventing automatic folding.

BACKGROUND OF THE INVENTION

Recently, with the improvement of people's living standard, more and more emphasis has been placed on outdoor recreational activities, some notable examples of which are cycling and mountain climbing. Take mountain climbing for instance. Many mountaineers would carry folding knives with them in case they need to cut or chop tree branches, thorns, and so forth on their way. Commercially available folding knives are composed essentially of a handle and a blade, wherein the blade is pivotally connected to the handle and is rotatable into and out of the handle. Once the blade of a folding knife is rotated out of the handle, the folding knife can be used for chopping or cutting. However, if the user exerts too much force or applies an oblique force to the folding knife while using it, the blade is very likely to fold automatically into the handle when subjected to the improperly applied force. This is very dangerous because the user's hand may end up being cut.

To solve the aforesaid safety problem, improvements have been made to the structure of folding knives. Please refer to FIG. 1 for a commonly seen example of such improved folding knives. The folding knife in FIG. 1 includes a handle 10, and the handle 10 is provided therein with a plate 100 formed with a resilient stopper 101. A blade 11 is pivotally connected to one side of the plate 100 and can be rotated into or out of the handle 10. When the blade 11 is received in the handle 10, the resilient stopper 101, which is resilient to a certain degree and extends toward the blade 11, presses resiliently against one side of the blade 11. Once the blade 11 is rotated out of the handle 10 (see FIG. 1), the resilient stopper 101 curves toward the blade 11, thanks to the resilience of the resilient stopper 101. As a result, the free end (i.e., the lower right end in FIG. 1) of the resilient stopper 101 moves to a position adjacent to one end of the blade 11 and presses against the blade 11. In FIG. 1, the lower right end of the resilient stopper 101 curves downward and presses against the upper left end of the blade 11.

When pressed against by the resilient stopper 101, the blade 11 cannot be folded easily into the handle 10. Even if the user tries to rotate the blade 11 into the handle 10, the resilient stopper 101 will prevent such rotation and keep the blade 11 from being folded. In order to fold the blade 11 properly, the user must push the resilient stopper 101 first, so the resilient stopper 101 is moved away from the position where it presses against the blade 11. Only then can the blade 11 be rotated. However, when the user holds the handle 10 and performs piercing or chopping actions with the folding knife 1, an excessively large force applied by the user or an improper chopping angle may subject the resilient stopper 101 to shocks or other forces that tend to drive the resilient stopper 101 away from the position where it presses against the blade 11. If that happens, the blade 11 may rotate toward the handle 10 instantly and cut the user's hand. It can be known from the above that neither the conventional nor the improved folding knife provides adequate safety in use.

Accordingly, the issue to be addressed by the present invention is to overcome the various drawbacks of the existing folding knives and design a folding knife whose blade is prevented from folding automatically. It is desirable that, once the blade is rotated out of the handle, the resilient stopper presses securely against the blade and yet still allows the user to fold the blade easily when needed, thus enhancing both the safety and convenience of the folding knife.

BRIEF SUMMARY OF THE INVENTION

In view of the aforementioned problems of the existing folding knives, the inventor of the present invention conducted extensive research and experiment and finally succeeded in developing a folding knife capable of preventing automatic folding as disclosed herein. The disclosed folding knife can prevent its blade from folding by accident and therefore features enhanced safety and increased convenience of use.

It is an object of the present invention to provide a folding knife capable of preventing automatic folding, wherein the folding knife includes a blade, a pivot, a handle, and a sliding element. The handle includes a first plate, a second plate, and a third plate. The blade is pivotally connected between the first plate and the second plate by the pivot. The second plate is provided with a resilient stopper, wherein the resilient stopper has a first end fixed to the second plate and a second end extending toward the first plate in a slanting manner. The third plate has one side corresponding in position to the second plate and concavely provided with an engaging hole. When the blade is fully rotated out of the handle, the second end of the resilient stopper presses against one end of the blade and thereby keeps the blade fully rotated out of the handle. The sliding element is slidably positioned on the resilient stopper. The sliding element has an engaging portion extending toward the third plate, and a resilient element is provided between one end of the sliding element and the second plate or the third plate. When the blade is received in the handle, the engaging portion is engaged in the engaging hole. When the blade is fully opened and pressed against by the second end of the resilient stopper, the sliding element moves along with the resilient stopper such that the engaging portion is disengaged from the engaging hole; moreover, the resilient element moves the sliding element and thereby drives the engaging portion away from the position corresponding to the engaging hole. As a result, the engaging portion presses against the third plate and fixes the resilient stopper at the position in which the resilient stopper presses against the blade. In other words, with the engaging portion pressing against the third plate, the resilient stopper is held pressing against the blade. Therefore, even if the force applied to the folding knife is excessively large or is applied at an improper angle while the folding knife is used, the resilient stopper will not be shifted away, by the resultant shocks or other forces, from the position where the resilient stopper presses against the blade. Consequently, not only is the blade effectively prevented from folding automatically, but also the user is protected from being cut by the blade.

It is another object of the present invention to provide the foregoing folding knife, wherein the resilient stopper is protrudingly provided with a projection, and the sliding element is formed with a sliding groove. The projection passes through the sliding groove such that the sliding element is slidably positioned on the resilient stopper.

It is still another object of the present invention to provide the foregoing folding knife, wherein one side of the sliding element that is adjacent to the engaging portion is provided with an actuating portion, and the actuating portion extends outward of the handle so as to be slid by the user. When it is desired to fold the blade, the user slides the actuating portion in such a way that the engaging portion is moved to the position corresponding to the engaging hole. Then, the actuating portion is further slid by the user to bring the engaging portion into engagement with the engaging hole while the resilient stopper is moved away from the position where it presses against the blade. The user can now fold the blade into the handle.

Yet another object of the present invention is to provide the foregoing folding knife, wherein the side of the third plate that corresponds in position to the second plate is concavely provided with a fixing groove, and the resilient element has one end fixed in the fixing groove and an opposite end connected to the sliding element.

BRIEF DESCRIPTION OF THE SEVERAL VIEWS OF THE DRAWINGS

The structure as well as a preferred mode of use, further objects, and advantages of the present invention will be best understood by referring to the following detailed description of an illustrative embodiment in conjunction with the accompanying drawings, in which.

DETAILED DESCRIPTION OF THE INVENTION

The inventor of the present invention has long been engaged in the research and development of folding knifes and hence found that the conventional folding knives are very likely to fold automatically during use and thereby injure the user. Although improvements have been made to provide such a conventional folding knife with a resilient stopper for fixing the blade in the open state, the resilient stopper, once subjected to shocks or other forces, may still be shifted away from the position where it presses against the blade, thus exposing the user to the risk of being cut by the blade. The industry has tried to solve this problem by making further improvements to the structure of the existing folding knives, but an ideal solution has yet to be found. Therefore, the inventor came up with a folding knife capable of preventing its blade from folding automatically, as a way to address the safety issues of the existing folding knives.

Figure 1:
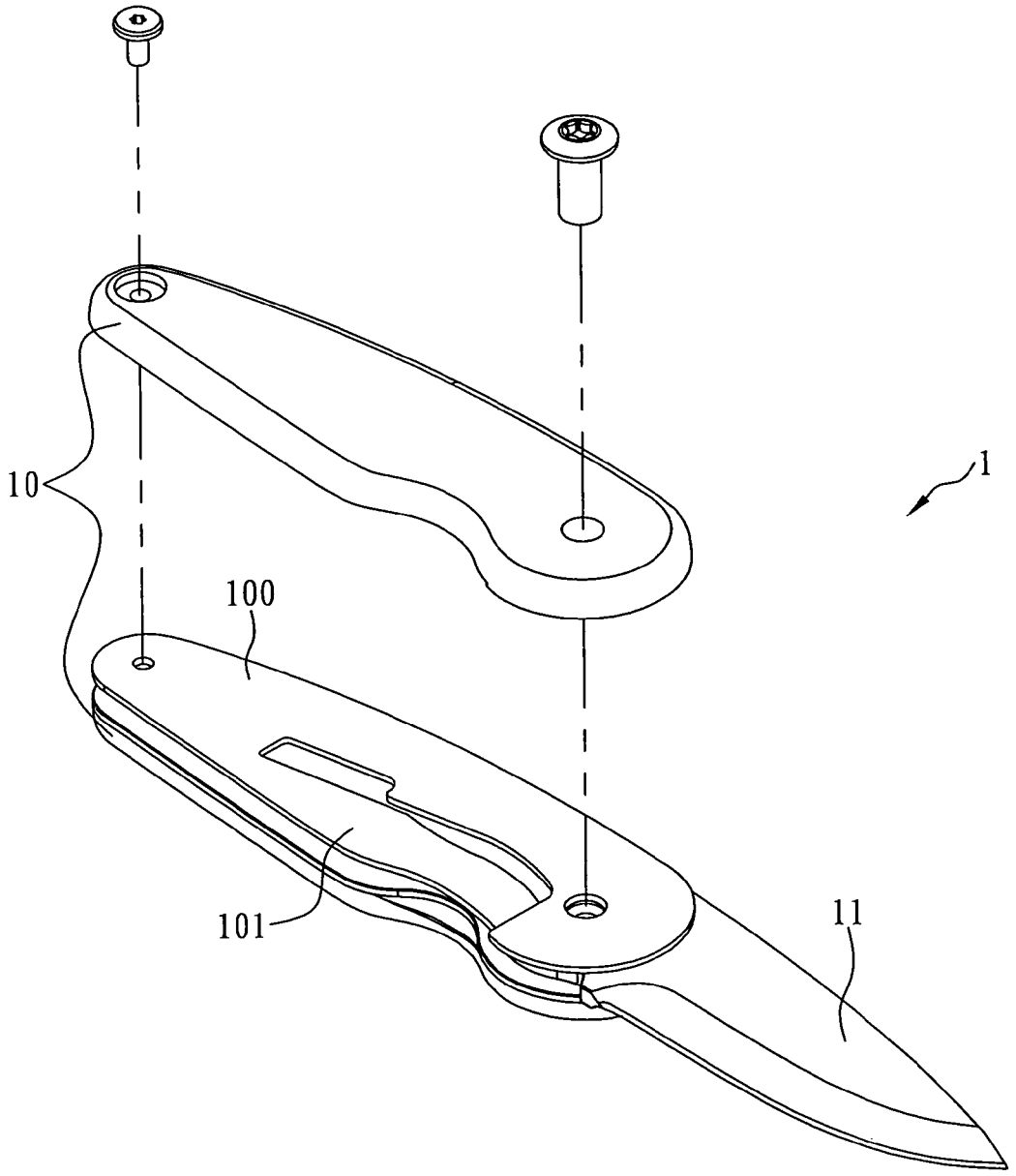
FIG. 1 (Prior Art)
FIG. 1 is an exploded perspective view of a conventional folding knife.
Figure 2:
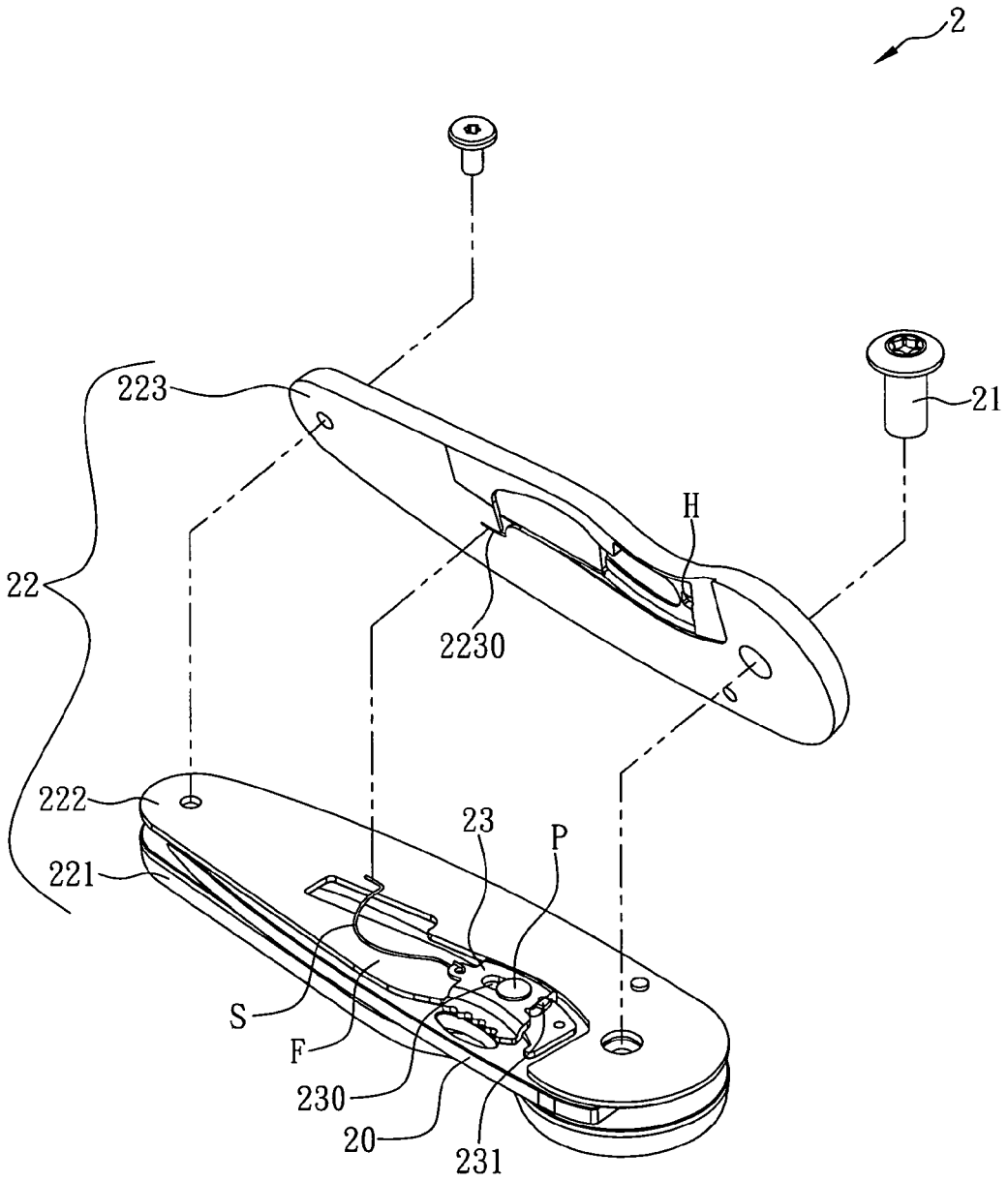
FIG. 2 is an exploded perspective view of a preferred embodiment of the present invention.

The present invention provides a folding knife capable of preventing automatic folding. Referring to FIG. 2 for a preferred embodiment of the present invention, a folding knife 2 includes a blade 20, a pivot 21, a handle 22, and a sliding element 23. The handle 22 includes a first plate 221, a second plate 222, and a third plate 223. The blade 20 is pivotally connected between the first plate 221 and the second plate 222 by the pivot 21. The second plate 222 is provided with a resilient stopper F. The resilient stopper F has a first end fixed to the second plate 222 and a second end extending toward the first plate 221 in a slanting manner. When the blade 20 is received in the handle 22, the resilient stopper F presses against one side of the blade 20. The resilient stopper F is protrudingly provided with a projection P, and the sliding element 23 is formed with a sliding groove 230. The projection P passes through the sliding groove 230 such that the sliding element 23 is slidably positioned on the resilient stopper F. However, the sliding element 23 and the resilient stopper F of the present invention are not limited to the foregoing design. For example, the sliding groove can be formed on the resilient stopper F while the projection is provided on the sliding element 23. In that case, the sliding element 23 can still be positioned slidably on the resilient stopper F by the projection extending through the sliding groove. All variations which a person skilled in the art can easily think of should fall within the scope of the present invention.

Figure 3:
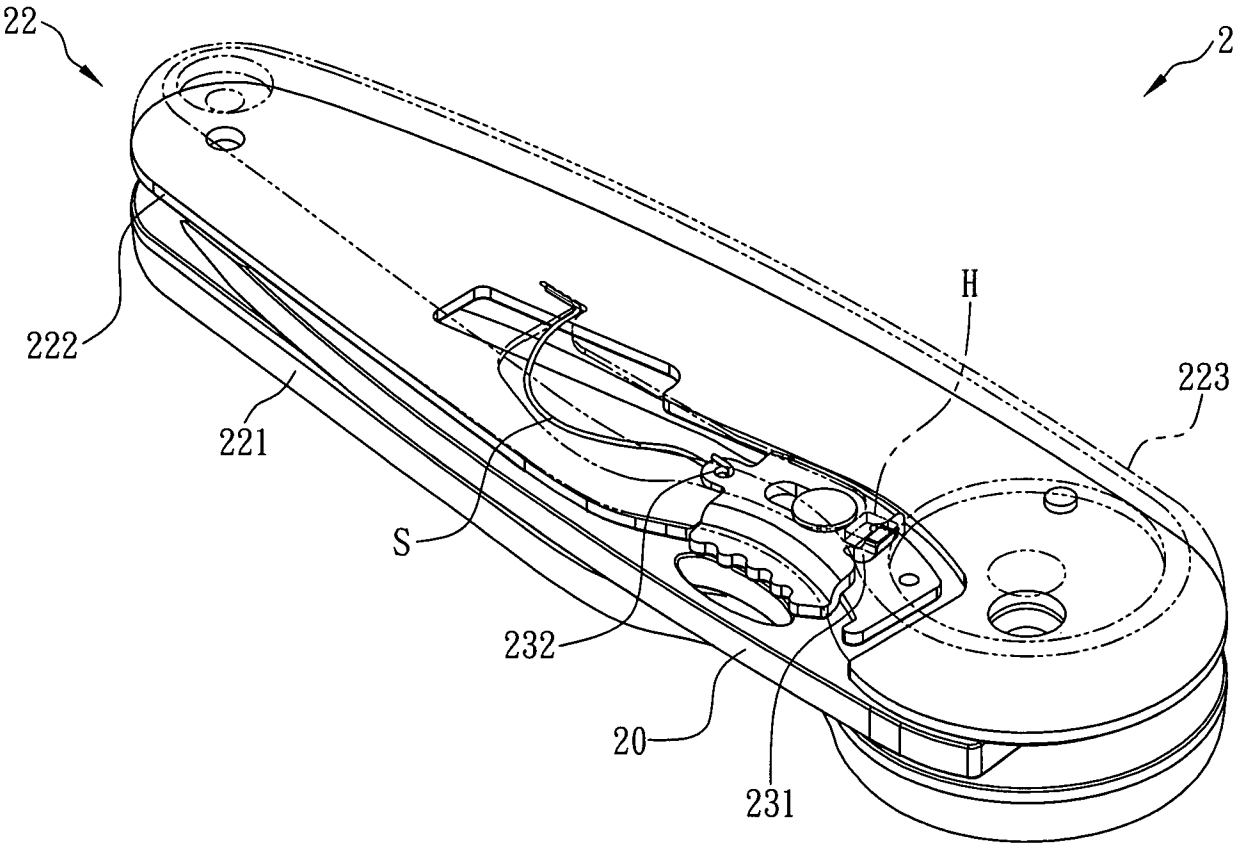
FIG. 3 is an assembled perspective view of the preferred embodiment depicted in FIG. 2.

As shown in FIG. 2, the third plate 223 has one side corresponding in position to the second plate 222 and concavely provided with an engaging hole H. Meanwhile, the sliding element 23 has an engaging portion 231 extending toward the third plate 223. Referring to FIG. 3, when the blade 20 is received in the handle 22, the engaging portion 231 is engaged in the engaging hole H. In addition, referring again to FIG. 2, a resilient element S is provided between one end of the sliding element 23 and the third plate 223. In this preferred embodiment, the side of the third plate 223 that corresponds in position to the second plate 222 is concavely provided with a fixing groove 2230, and the sliding element 23 is formed with a hook hole 232 (see FIG. 3). The resilient element S has a first end fixed in the fixing groove 2230 and a second end hooked to the hook hole 232 and thus connected to the sliding element 23. Nevertheless, the connections of the resilient element S are not limited to the above. For instance, the first end of the resilient element S can be secured to the second plate 222, and the second end of the resilient element S, connected to the sliding element 23, without compromising the intended effects of the present invention. All combinations and variations that are readily conceivable by a person skilled in the art should be covered by the present invention.

Figure 4:
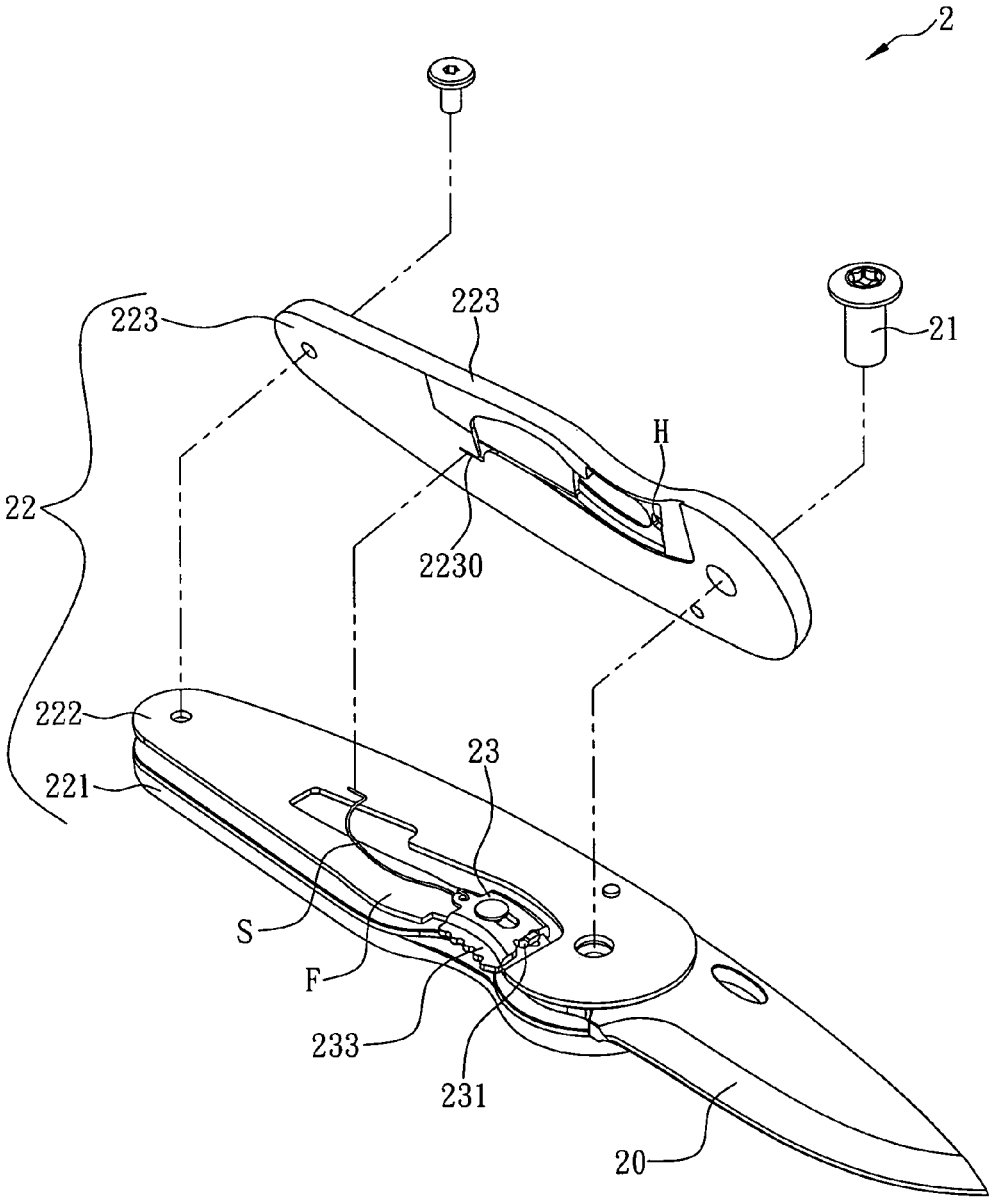
FIG. 4 is another exploded perspective view of the preferred embodiment depicted in FIG. 2.
Figure 5:
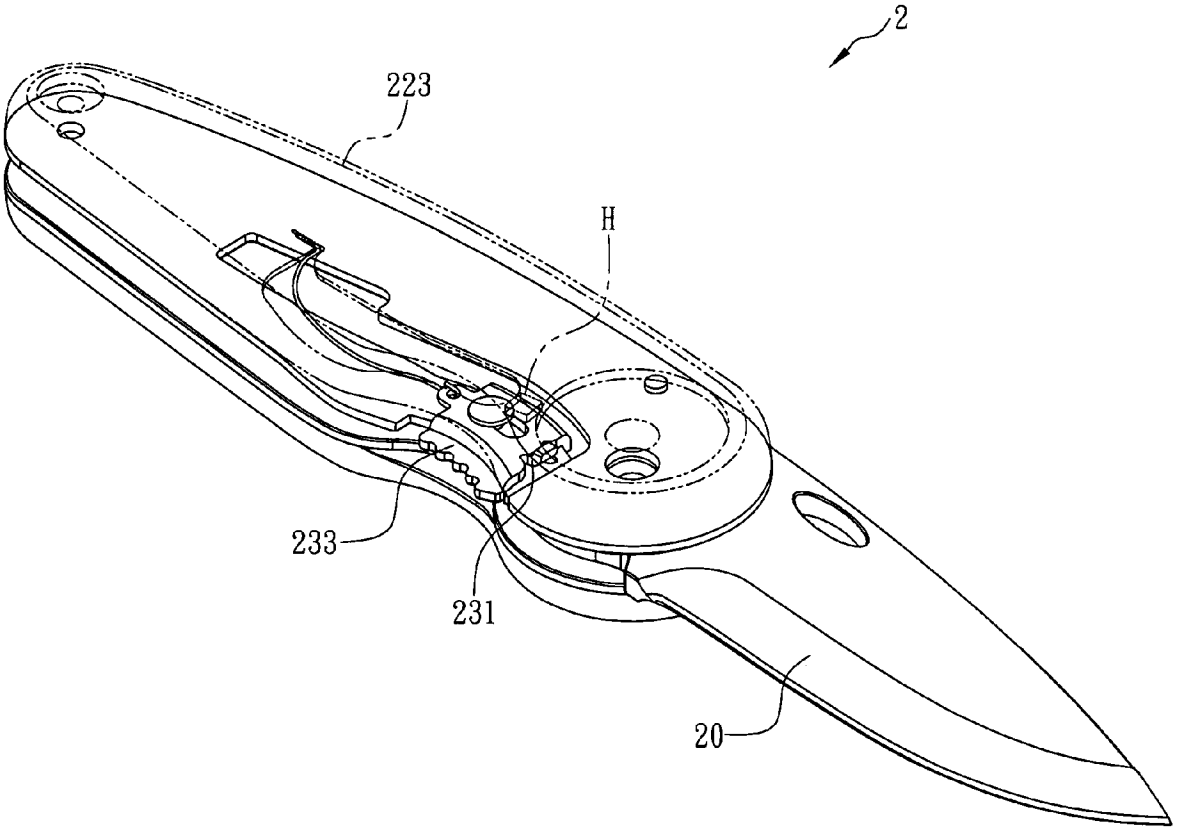
FIG. 5 is another assembled perspective view of the preferred embodiment depicted in FIG. 2.
Figure 6:
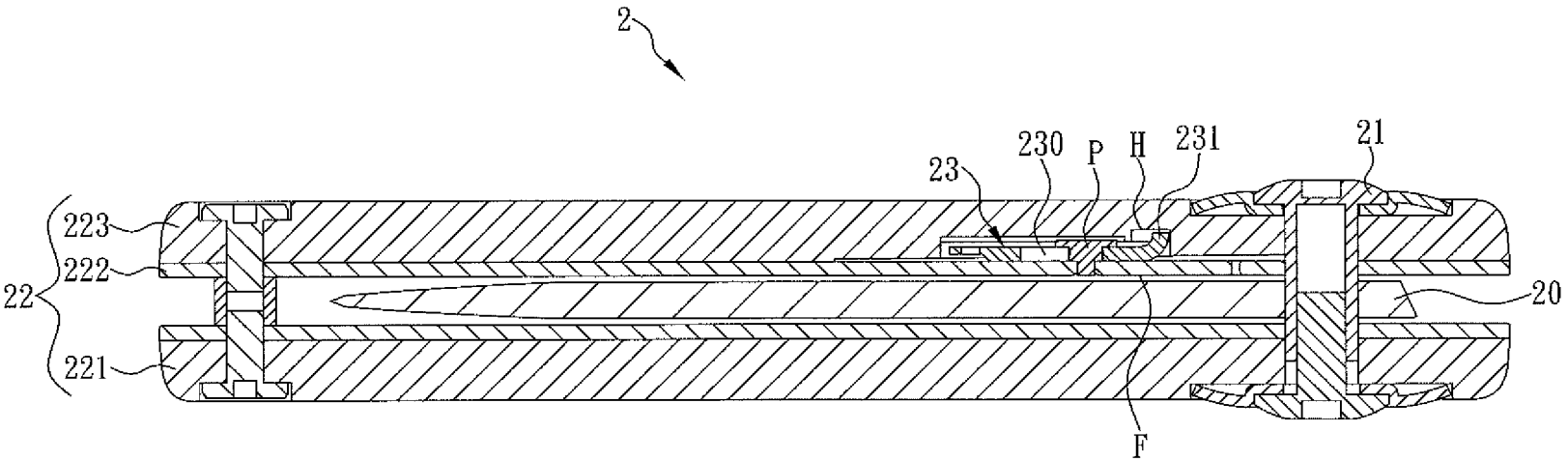
FIG. 6 is a cross-sectional longitudinal view of FIG. 4 with the blade closed.
Figure 7:
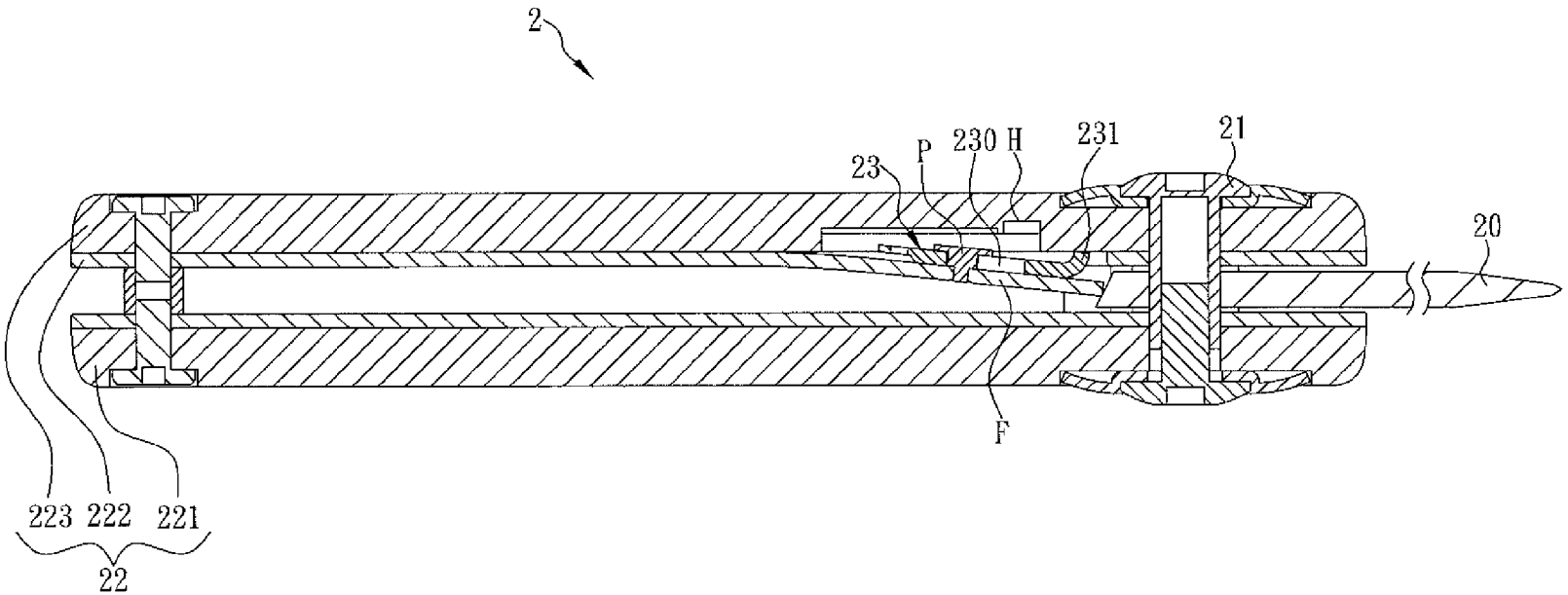
FIG. 7 is a cross-sectional longitudinal view of FIG. 4.

With reference to FIG. 4, when the blade 20 is fully rotated out of the handle 22, the second end (i.e., the right end in FIG. 4) of the resilient stopper F presses against one end of the blade 20 to keep the blade 20 in a state in which it is fully rotated out of the handle 22. More specifically, the resilient stopper F shifts in position as a result of its resilience, causing the second end of the resilient stopper F to press against the blade 20. Meanwhile, the sliding element 23 moves along with the resilient stopper F toward the first plate 221, causing the engaging portion 231 to disengage from the engaging hole H. The sliding element 23 in this state is pushed by the resilient restoring force of the resilient element S and therefore slides toward the blade 20. In consequence, referring to FIG. 5, the engaging portion 231 is moved away from the position corresponding to the engaging hole H and presses against the third plate 223. Referring back to FIG. 4, as the position of the resilient stopper F is limited by the sliding element 23, the resilient stopper F is now fixed securely at and cannot be shifted away from the position where it presses against the blade 20. Thus, the blade 20 is fixed in the opened state.

In this preferred embodiment, referring to FIG. 4, the sliding element 23 has one side adjacent to the engaging portion 231 and provided with an actuating portion 233. The actuating portion 233 extends out of the handle 22 so as to be slid by the user. When it is desired to fold the blade 20, the user slides the actuating portion 233 and thereby moves the engaging portion 231 to the position corresponding to the engaging hole H (see FIG. 2). Then, the user slides the actuating portion 233 further so that not only the engaging portion 231 is engaged in the engaging hole H (see FIG. 3), but also the resilient stopper F is moved away from the position where it presses against the blade 20. Once the foregoing actions are done, the resilient stopper F stops pressing against the blade 20, and the blade 20 is allowed to be folded into the handle 22. It can be known from the above description that, while folding the blade 20, the user only has to slide the actuating portion 233 of the sliding element 23 with one hand, and the resilient stopper F will rapidly move away from the position where it presses against the blade 20. This not only simplifies the operation of the folding knife 2, but also protects the user from being cut by the blade 20 while the blade 20 is being folded. Consequently, the convenience and safety of the folding knife 2 are both significantly enhanced.

According to the embodiment described above, the structural design of the present invention is such that, when the blade 20 is rotated out of the handle 22, the engaging portion 231 presses against the third plate 223 and thereby keeps the resilient stopper F pressing against the blade 20; in other words, the resilient stopper F is prevented from shifting away from the position where it presses against the blade 20. Therefore, even if the folding knife 2 is used too forcefully or at an improper angle while piercing or chopping an object, the resilient stopper F will not be moved away by the resultant shocks (or other forces) from the position where it presses against the blade 20. By preventing the blade 20 from folding automatically, the present invention protects the user from being cut by the blade 20. Moreover, due to the structural simplicity of the present invention, the folding knife disclosed herein can be manufactured without a high production cost, which is advantageous to mass production and cost control.

While the invention herein disclosed has been described by means of specific embodiments, numerous modifications and variations could be made thereto by those skilled in the art without departing from the scope of the invention set forth in the claims.

What is claimed is:

1. A folding knife capable of preventing automatic folding, comprising:

a blade;

a pivot;

a handle comprising a first plate, a second plate, and a third plate, wherein the blade is pivotally connected between the first plate and the second plate by the pivot, the second plate is provided with a resilient stopper, the resilient stopper has a first end fixed to the second plate and a second end extending toward the first plate in a slanting manner, and the third plate has a side corresponding in position to the second plate and concavely provided with an engaging hole; wherein when the blade is fully rotated out of the handle, the second end of the resilient stopper presses against an end of the blade and thereby keeps the blade fully rotated out of the handle; and a sliding element slidably positioned on the resilient stopper, wherein the sliding element has an engaging portion extending toward the third plate, a resilient element is provided between an end of the sliding element and the second plate or the third plate; wherein when the blade is received in the handle, the engaging portion is engaged in the engaging hole, and when the blade is fully opened and is pressed against by the second end of the resilient stopper, the second end of the resilient stopper moves toward the first plate in the slanting manner such that the resilient element moves the sliding element in such a way that the engaging portion is disengaged from the engaging hole and presses against the third plate, thereby fixing the resilient stopper at a position where the resilient stopper presses against the blade.

2. The folding knife of claim 1, wherein the resilient stopper is protrudingly provided with a projection, the sliding element is provided with a sliding groove and, when the projection passes through the sliding groove, the sliding element is slidably positioned on the resilient stopper.

3. The folding knife of claim 1, wherein the sliding element is protrudingly provided with a projection, and the resilient stopper is provided with a sliding groove and, when the projection passes through the sliding groove, the sliding element is slidably positioned on the resilient stopper.

4. The folding knife of claim 2, wherein the side of the third plate that corresponds in position to the second plate is concavely provided with a fixing groove, and the resilient element has a first end fixed in the fixing groove and a second end connected to the sliding element.

5. The folding knife of claim 3, wherein the side of the third plate that corresponds in position to the second plate is concavely provided with a fixing groove, and the resilient element has a first end fixed in the fixing groove and a second end connected to the sliding element.

6. The folding knife of claim 4, wherein the sliding element has a hook hole, and the second end of the resilient element is hooked to the hook hole and thereby connected to the sliding element.

7. The folding knife of claim 5, wherein the sliding element has a hook hole, and the second end of the resilient element is hooked to the hook hole and thereby connected to the sliding element.

8. The folding knife of claim 6, wherein the sliding element has a side adjacent to the engaging portion and provided with an actuating portion, and the actuating portion extends outward of the handle so as to be slid by a user.

9. The folding knife of claim 7, wherein the sliding element has a side adjacent to the engaging portion and provided with an actuating portion, and the actuating portion extends outward of the handle so as to be slid by a user.

* * * * *